United States Patent [19]

Asher

[11] 4,275,611

[45] Jun. 30, 1981

[54] JOYSTICK CONTROLLER

[75] Inventor: James C. Asher, San Jose, Calif.

[73] Assignee: Atari, Inc., Sunnyvale, Calif.

[21] Appl. No.: 25,122

[22] Filed: Mar. 29, 1979

[51] Int. Cl.[3] ..... G05G 9/04; H01C 10/16

[52] U.S. Cl. ..... 74/471 XY; 338/128

[58] Field of Search ..... 74/471 XY, 501 M; 137/636.2; 200/6 A; 338/128

[56] References Cited

U.S. PATENT DOCUMENTS

| | | | |
|---|---|---|---|
| 2,754,411 | 7/1956 | Dohrmann | 200/6 A X |
| 2,940,357 | 6/1960 | Oswold | 74/471 XY |
| 2,976,742 | 3/1961 | Miscovich | 137/636.2 X |
| 3,030,459 | 4/1962 | Elliott et al. | 200/6 A |
| 3,204,584 | 9/1965 | Mladjan | 74/471 XY X |
| 3,290,455 | 12/1966 | Christensen | 200/6 A |
| 3,942,148 | 3/1976 | Nishioka | 74/471 XY X |

FOREIGN PATENT DOCUMENTS

| | | | |
|---|---|---|---|
| 2642055 | 9/1976 | Fed. Rep. of Germany | 74/501 M |

*Primary Examiner*—Allan D. Herrmann

*Attorney, Agent, or Firm*—Townsend and Townsend

[57] ABSTRACT

An electrical control device having a joystick or lever manually movable in the X and Y directions to actuate a pair of electrical components having respective rotatable shafts. The controller includes a housing having a top cover provided with an opening through which the lever extends. The lower end of the lever is pivotally mounted in a socket on the bottom of the housing and a ball joint is carried by the lever intermediate its ends. The ball joint is pivotally coupled to a control plate shiftable in the housing beneath the top cover, the plate being biased into an equilibrium position by a number of leaf springs normally engaging respective side margins of the plate. The plate has a pair of slots in its lower surface, the slots being mutually perpendicular and vertical projections on the outer ends of a pair of bell cranks are shiftably received within respective slots in the plate. The bell cranks are coupled to the rotatable shafts of respective electrical components so that, when the plate is moved in any one of a number of different directions upon manual movement of the lever, one or both of the rotatable shafts of the electrical components are rotated to actuate the components.

12 Claims, 3 Drawing Figures

JOYSTICK CONTROLLER

This invention relates to improvements in the construction of control devices of the joystick type and, more particularly, to an electrical X-Y controller which has a relatively few number of parts and provides greater sensitivity than that provided with conventional joystick controllers.

BACKGROUND OF THE INVENTION

Conventional X-Y potentiometer controller devices use curved bails that intersect centrally to rotate the potentiometer shafts. These designs are of relatively large size and the control stick movement is generally a 1:1 ratio with potentiometer shaft rotation. This does not provide much sensitivity, a desired sensitivity being that in which the above ratio is greater than 1:1. Another disadvantage of conventional joystick devices is their relatively high production costs.

Representative U.S. patents showing X-Y controllers are as follows: Nos. 1,715,781, 2,544,225, 2,847,661, 3,436,476, 3,541,541, 3,659,284 and 3,984,628. For the most part, the controllers of these patents all have the same drawbacks, namely the relatively high cost, high number of operating parts, and relatively low sensitivity. Because of these drawbacks, a need has continued for a low cost, simplified X-Y controller which gives a ratio of stick movement to shaft rotation of greater than 1:1.

SUMMARY OF THE INVENTION

This invention satisfies the aforesaid need by providing an X-Y controller of the joystick type which is simple and rugged in construction, has a relatively few number of parts, can be easily maintained and gives sensitivity in the ratio of 3:1 or more between the stick movement and rotation of the shaft of the electrical components associated with the controller.

To this end, the present invention provides a controller having a support which can be in the form of an open top housing and a control stick or lever which has its lower end pivotally mounted on the support to allow angular movement of the lever in any one of a number of different directions, such as along X and Y axes and in directions intermediate such axes. The lever has a ball joint coupled with a control member which preferably is in the form of a flat plate, the control member being biased by spring means into an equilibrium position. Crank means couples the control member with each rotatable shaft of the pair of electrical components, such as potentiometers, so that movement of the control lever and thereby the control member in any one of a number of different directions in the plane of the control member causes rotation of one or both of the shafts of the two electrical components and actuation of one or both of the components themselves. Thus, rotation of each shaft in opposed directions about a zero position can be achieved so that at least a 3:1 ratio between shaft movement and lever movement can be achieved notwithstanding a relatively simplified construction of the controller and a low production cost thereof.

The primary object of this invention is to provide an improved X-Y controller of the type described which is simple and rugged in construction, is inexpensive to produce and maintain, and gives high sensitivity, of the order of 3:1 between control lever movement and rotational movement of the shafts of the electrical components.

Other objects of this invention will become apparent as the following specification progresses, references being had to the accompanying drawing for an illustration of a preferred embodiment of the invention.

IN THE DRAWINGS

Figure 1:
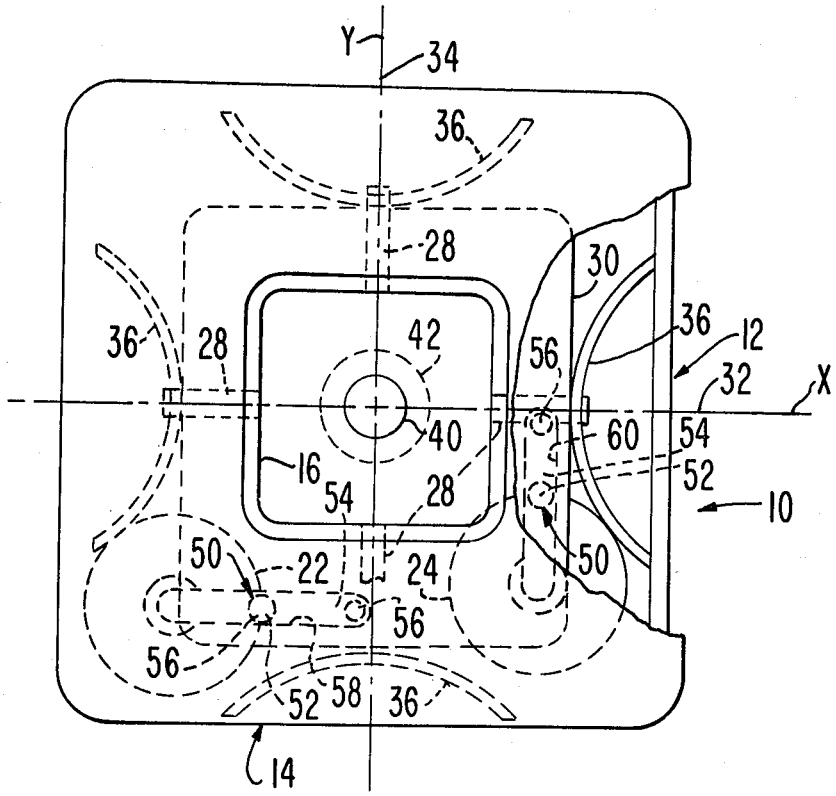
FIG. 1 is a top plan view of the controller of this invention, parts being broken away and dashed lines illustrating details of construction.
Figure 2:
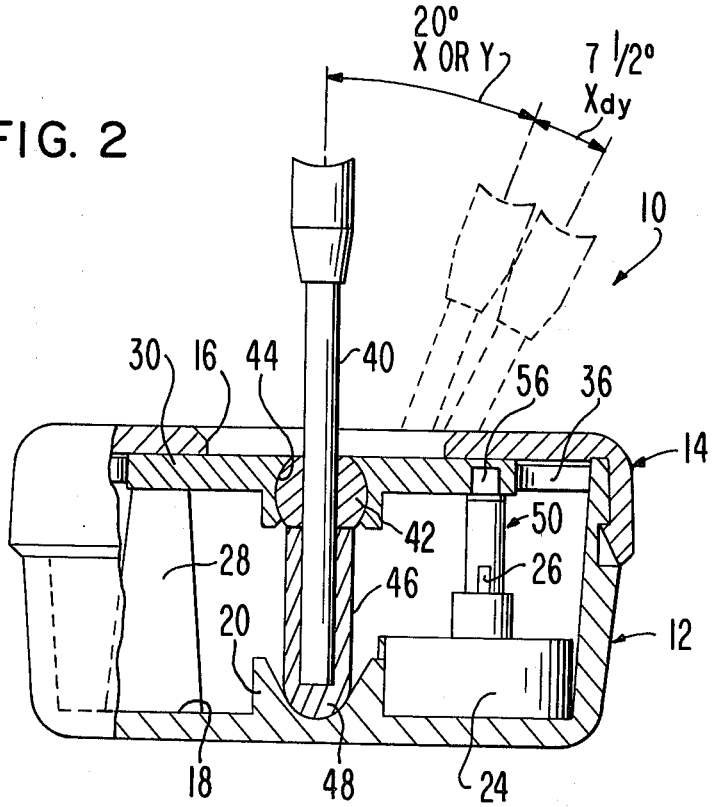
FIG. 2 is a side elevational view, partly in section of the controller of FIG. 1.

The controller of the present invention is broadly denoted by the numeral 10 and it includes an open top housing or base 12 which is generally removably covered by a top member 14 having a rectangular opening 16 therein. Housing 12 has a generally flat bottom surface 18 and the housing is generally rectangular as is top 14 as shown in FIGS. 1 and 2. A socket 20 is centrally located on bottom surface 18 midway between the side margins of surface 18, the socket having an open top and being disposed adjacent to a pair of potentiometers 22 and 24 carried on bottom surface 18 near a pair of adjacent corners of housing 12 as shown in FIG. 1, potentiometer 22 being omitted from FIG. 2 merely to simplify the drawing. Each potentiometer has a generally vertical shaft 26 which can be rotated in both directions about an equilibrium or zero position.

Housing 12 has a plurality of webs 28 integral therewith and extending inwardly from the sides thereof. For purposes of illustration, there are at least four webs 28, only one of the webs being shown in FIG. 2. Each web 28 has a flat upper surface and the upper surfaces of the various webs are at the same height above surface 18 to present a support for a shiftable control member or plate 30 which is generally rectangular or square and smaller in size than the housing 12, plate 30 being shown generally in dashed lines in FIG. 1 in its equilibrium position. Plate 30 is slidable over the upper flat surfaces of webs 28 so that the plate can move virtually in all directions in its plane at least to a limited extent. Thus, the plate can move back and forth in an X direction denoted by axis 32, back and forth in a Y direction denoted by an axis 34, or in directions between the X and Y directions.

Means are provided for biasing plate 30 into its equilibrium central position as shown in FIG. 1 in dashed lines. To this end, four bowed leaf springs 36 are provided for the four flat sides of plate 30, each spring having a convex face which engages a respective side of the plate 30, each spring being slightly under compression so that it constantly applys a bias force to the plate. All of the four springs 36 are substantially identical in construction and size so they apply equal bias forces to plate 30 to center the same within housing 12.

The springs 36 can be mounted in any suitable manner so that they perform the function mentioned above. Moreover, the upper edge of each leaf spring is adjacent to the bottom surface of top 14 so that the springs can shift relative to top 14 and allow movement of plate 30 relative to base 12. In a preferred embodiment, springs 36 are integral at their mid-portions to plate 30. To this end, the plate and springs are formed from a moldable, plastic material.

A joystick or lever 40 extends through central opening 16 in top 14 and lever 40 has a ball joint 42 pivotally mounted in a central opening 44 in plate 30. Lever 40 has a lower portion received within a sleeve 46 provided with a spherical bottom part 48 pivotally received in socket 20. When the upper end of lever 40 is manually shifted, it pivots about a horizontal axis through the junction between part 48 and socket 20 and causes shifting movement of plate 30 against the bias force of one or a pair of adjacent springs 36. When the lever is released, plate 30 returns to its equilibrium central position because of the bias forces of the springs.

Figure 3:
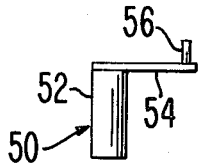
FIG. 3 is a side elevational view of the bell crank forming a part of the invention.

Means are provided to couple plate 30 with potentiometers 22 and 24 so that the potentiometers are actuated as a function of the movement of plate 30. To this end, a pair of bell cranks 50 (FIG. 3) are provided, there being a bell crank for each potentiometer, respectively. Each bell crank includes a vertical part 52 for rigid attachment to the shaft 26 of the corresponding potentiometer, a horizontal part 54 extending laterally from the top of part 52, and a vertical pin 56 secured to and extending upwardly from the outer end of part 54.

Pins 56 of bell cranks 50 are slidably received within respective slots 58 and 60 in the bottom surface portions of plate 30 which overlie respective potentiometers 22 and 24. As shown in FIG. 1, slots 58 and 60 are longer than the distance between part 52 and pin 56 of each bell crank, respectively. Slot 60 has a longitudinal axis which is perpendicular to the longitudinal axis of slot 58.

Bell cranks 50 are attached to shafts 26 of respective potentiometers 22 and 24 so that, when plate 30 is in its equilibrium position, potentiometers 22 and 24 are also in their equilibrium locations yet shafts 26 can be rotated in opposed directions. Movement of plate 30 in opposed directions along the X axis 32 will cause rotation of shaft 26 to potentiometer 24 in opposite directions. Similarly, movement of plate 30 in opposed directions along the Y axis 34 will cause rotation of shaft 26 of potentiometer 22 in opposite directions.

In use, the potentiometers are electrically coupled to circuitry (not shown) which is to be actuated or controlled by the rotation of shafts 26 of the potentiometers. The user of controller 10 then manually grasps lever 40 and manipulates it so that the lever is pivoted in a desired direction. For instance, if the lever is shifted upwardly when viewing FIG. 1 along the Y axis 34, plate 30 will move in this direction to cause rotation of shaft 26 of potentiometer 22 in a counterclockwise direction. When this occurs, there will be no actuation of potentiometer 24 because pin 56 of the corresponding bell crank 50 will merely move longitudinally of slot 60.

When lever 40 is moved to the right along X axis 32, plate 30 will also move in this direction and will cause clockwise rotation of shaft 26 of potentiometer 24. When this occurs, there will be no actuation of potentiometer 22 because pin 56 of the corresponding bell crank will merely move longitudinally of slot 58. A typical maximum travel of lever 40 in either the X or the Y directions is 20° from the vertical.

If it is desired to operate both potentiometers simultaneously lever 40 can be shifted along a diagonal between the X and Y axis 32 and 34. When this occurs, both shafts 26 of both potentiometers 22 and 24 are rotated, depending upon the direction of movement of the lever and the extent of pivotal movement of the lever.

While potentiometers 22 and 24 have been shown to be actuated by the movement of lever 40 and plate 30, other electrical components, such as on/off switches, variable capacitors or variable inductances could be used with controller 10 in place of the potentiometers.

Controller 10 provides a design concept which allows a much smaller size of controller to be used as well as fewer parts in the controller. Also, a 3:1 ratio or more can be generated between the lever movement and shaft rotation, giving much greater sensitivity. Moreover, the shafts of the potentiometers are mounted vertically, allowing easy access for adjustment of the potentiometers electrically with a mechanical neutral position for the same. Because of the ball joint connection between plate 30 and lever 40, plate 30 can be easily shifted in any desired X-Y direction or any combination of X-Y movements while causing immediate actuation of either or both of the potentiometers depending upon the direction of movement of lever 40.

I claim:

1. An X-Y controller comprising: a support; a pair of electrical components carried by the support, each component having a rotatable shaft; a plate mounted on the support for movement relative thereto in any one of a number of directions, said plate having a number of side margins; means engaging the side margins of the plate for biasing the plate into an equilibrium position relative to said support; a lever having a ball joint coupled with the plate and extending therethrough, one end of the lever being pivotally coupled to the support to permit movement of the plate relative to the support in a plane as the lever is pivoted about an axis through said one end of the lever; and crank means coupling each shaft, respectively, to the plate to permit rotation of the shaft as a function of the movement of the plate relative to said support.

2. A controller as set forth in claim 1, wherein said crank means for coupling each shaft to the plate comprises a bell crank for each shaft, respectively.

3. A controller as set forth in claim 2, wherein said plate has a lower surface, there being a pair of relatively angularly disposed slots in the lower surface of the plate, the bell cranks having projections extending into respective slots.

4. A controller as set forth in claim 3, wherein the projections are intermediate the ends of the slots when the plate is in its equilibrium position.

5. A controller as set forth in claim 3, wherein the plane of the plate is generally perpendicular to the shafts of said components, said slots being generally perpendicular to each other, the directions of movement of the plate being in the plane of the plate.

6. A controller as set forth in claim 1, wherein said plate has a number of side margins, said bias means including a number of springs engaging respective side margins of the plate.

7. A controller as set forth in claim 6, wherein each spring comprises a leaf spring carried by the support.

8. A controller as set forth in claim 1, wherein the support comprises a housing having an open top, the housing having a bottom surface provided with a socket centrally located thereon, the lever having a ball-shaped end member pivotally received in the socket.

9. A controller as set forth in claim 8, wherein the housing has a top thereon, the top having an opening therethrough, the lever extending through the opening and being shiftable in a number of directions relative thereto.

10. A controller as set forth in claim 9, wherein the control member includes a plate beneath, in proximity to and shiftable relative to said top.

11. An X-Y controller comprising: a housing having a sidewall provided with a number of spaced webs thereon, each web having a generally flat upper surface; a pair of electrical components carried in the housing, each component having a rotatable shaft; a plate supported on and slidable in any one of a number of directions over the upper flat surfaces of the webs, said plate having a number of side margins; a number of springs engaging respective side margins of the plate to urge the plate into an equilibrium position relative to said housing; a lever having a ball joint coupled with the plate and extending therethrough, one end of the lever being pivotally coupled to the housing to permit movement of the plate relative to the housing in a plane as the lever is pivoted about an axis through said one end of the lever; and means coupling each shaft, respectively, to the plate to permit rotation of the shaft as a function of the movement of the plate relative to said housing.

12. A controller as set forth in claim 11, wherein the plate has a number of flat side faces, said springs being bowed leaf springs having convex surface portions engaging respective side faces of the plate.

* * * * *